United States Patent [19]

Gartner

[11] Patent Number: 4,647,012

[45] Date of Patent: Mar. 3, 1987

[54] INJECTION VALVE FOR MIXTURE-COMPRESSING INTERNAL COMBUSTION ENGINES

[75] Inventor: Jurij Gartner, Germering, Fed. Rep. of Germany

[73] Assignee: Bayerische Motoren Werke Aktiengesellschaft, Fed. Rep. of Germany

[21] Appl. No.: 822,325

[22] Filed: Jan. 27, 1986

[30] Foreign Application Priority Data

Jan. 29, 1985 [DE] Fed. Rep. of Germany ..... 3502919

[51] Int. Cl.[4] ..... F02M 61/14

[52] U.S. Cl. ..... 251/148; 123/470; 251/900; 285/23

[58] Field of Search ..... 123/470; 137/377; 239/288, 551, 600; 251/148, 900; 285/23, 45

[56] References Cited

U.S. PATENT DOCUMENTS 2,720,219 10/1955 Grove et al. ..... 251/210 X 4,307,693 12/1981 Glockler et al. ..... 123/470

4,362,323 12/1982 Lodder et al. ..... 285/23 X

FOREIGN PATENT DOCUMENTS 3406487 8/1985 Fed. Rep. of Germany ..... 123/470

*Primary Examiner*—Gerald A. Michalsky

*Attorney, Agent, or Firm*—Barnes & Thornburg

[57] ABSTRACT

An injection valve for a mixture-compressing internal combustion engines which is retained in the mounting bore in the suction pipe by way of a sealing ring. In order not to damage the sealing ring during the insertion of the injection valve into the mounting bore of the suction pipe, an axially displaceable sleeve is proposed according to the invention which slides on a cylindrical section of the injection valve. The sleeve includes a conical forward section that surrounds the sealing ring. During the installation of the injection valve, the sleeve is supported at the walls of the suction pipe and guides the sealing ring into the mounting bore without contact with the edges of the mounting bore.

7 Claims, 2 Drawing Figures

INJECTION VALVE FOR MIXTURE-COMPRESSING INTERNAL COMBUSTION ENGINES

Figure 1:
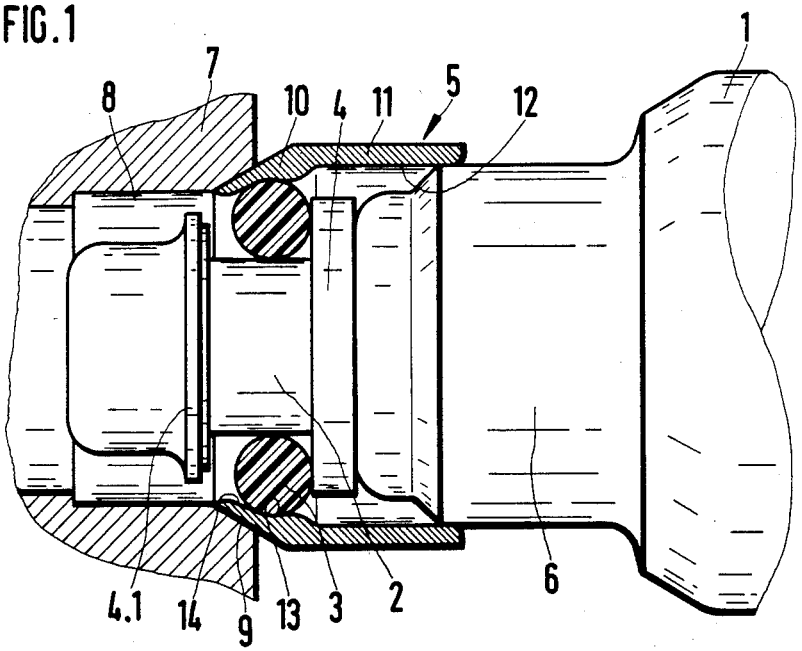

The present invention relates to an injection valve for mixture-compressing internal combustion engines, especially for individual suction pipe injection, which is retained on the discharge side by a plug connection by means of a mouthpiece in a wall aperture of the suction pipe under interposition of a rubber-elastic sealing ring.

With this known type of construction the O-ring arranged on the mouthpiece of the injection valve is radially compressed in the suction pipe wall during the insertion into the mounting bore. The mounting bore customarily includes for that purpose a chamfer or bevel on the insertion side, by means of which the compression of the O-ring is initiated during the insertion into the mounting bore. This bevel or chamfer as a rule is relatively low in the insertion direction for structural reasons within the area about the mounting bore and is constructed under a relatively large cone angle. This results in a relatively sharp edge at the transition from the mounting bore into the chamfer which may lead to a damage of the O-ring when the mouthpiece of the injection nozzle is applied eccentrically with respect to the mounting bore.

This danger is particularly large with the simultaneous installation of several injection valves in the individual suction pipes of a suction pipe system if the injection valves are arranged at a common fuel distribution line on the fuel supply side. For the purpose of noise decoupling between the injection valves and the fuel distribution lines, a plug-in arrangement is provided thereby with interposed sealing ring, similar to the plug-in arrangement described hereinabove on the suction pipe side. Owing to this plug-in arrangement, such injection valve is movable to some extent relative to the fuel distribution line so that with the simultaneous installation of the injection valves, one has to reckon with eccentric positions of some injection valves in their mounting bores.

In order to alleviate this problem, it has already been proposed in a prior patent application to arrange a centering device on the free end of the mouthpiece. This has proved excellent as centering assist. However, even such a centering device could not always avoid that damages of the sealing ring occurred, especially when the injection valve was applied obliquely notwithstanding the centering assist and was pressed with force into the mounting bore.

The object of the present invention resides in further developing in injection valve of the aforementioned type in such a manner that a damage of the sealing ring during the installation is precluded.

The underlying problems are solved according to the present invention in that a sleeve which is axially displaceably arranged on the injection valve, is provided in the free end area of the mouthpiece which, in its first end position, surrounds the sealing ring and in its second end position releases the sealing ring. By means of the sleeve in accordance with the present invention, the sealing ring is protected both during the period of time after the manufacture of the injection valve up to its installation as also during the installation. The displacement of the sleeve and therewith the release of the sealing ring will be attained only during the installation of the injection valve.

An advantageous inner contour of the sleeve is obtained if the sleeve includes a first cylindrical inner section and a second conical section at the forward end whose smallest diameter is smaller than the inner diameter of the wall aperture. It is assured thereby that during the installation of the injection valve the sealing ring slides easily into the mounting bore free of damages. On the other hand, the insertion of the injection valve is not impaired thereby.

If the first cylindrical inner section has two different diameters, whereby the larger diameter serves as guide surfaces on the valve body of the injection valve and the smaller diameter corresponds to the outer diameter of the sealing ring, the advantage is achieved that without further auxiliary means a safe axial displacement of the sleeve is made possible as also a secure retention during the period of time in which the sleeve is not installed. In particular, no further auxiliary means such as adhesive strips, clamps, etc. are necessary in order to use as protection for the sealing ring up to the installation of the injection valve.

If, according to another feature of the present invention, the outer contour of the sleeve has a conically shaped section at its forward end, then the sleeve simultaneously assumes a centering function so that the application of the injection valve is very considerably facilitated, especially if several injection valves are to be installed at the same time.

If the mounting bores are provided with an insertion bevel, then according to a further feature of the present invention it is appropriate if the magnitude of the half-cone angle of the conical section corresponds to the magnitude of the bevel angle.

Figure 2:
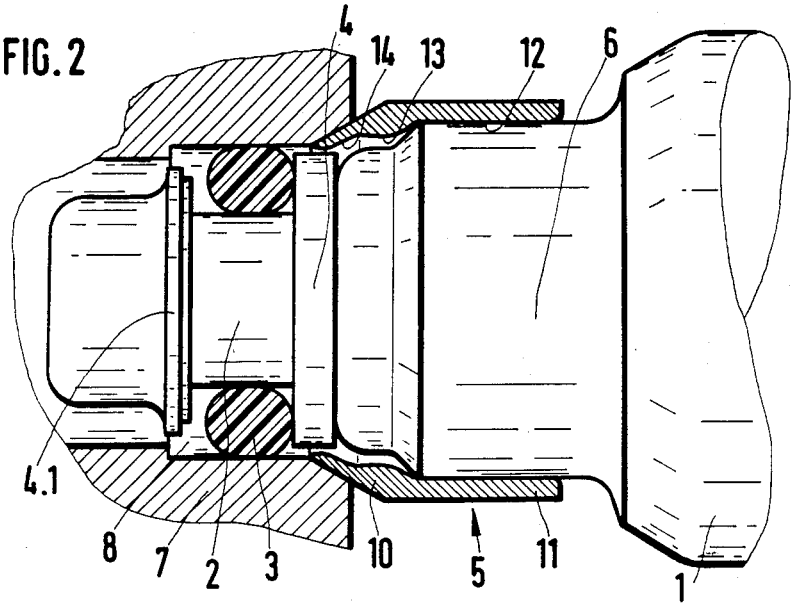

These and other objects, features and advantages of the present invention will become more apparent from the following description when taken in connection with the accompanying drawing which shows, for purposes of illustration only, one embodiment in accordance with the present invention, and wherein:

FIG. 1 is a schematic partial cross-sectional view of the injection valve in accordance with the present invention during the beginning of the installation process thereof; and FIG. 2 is a partial cross-sectional view, similar to FIG. 1, through an installed injection valve in accordance with the present invention.

Referring now to the drawing wherein like reference numerals are used throughout the two views to designate like parts, and more particularly to FIG. 1, the forward part of an injection valve 1 for a mixture-compressing internal combustion engine, not shown in detail, is schematically illustrated in this figure. It carries on its forward mouthpiece 2 a sealing ring 3 which is preferably constructed as O-ring. The sealing ring 3 is supported in the axial direction at a shoulder 4 and 4.1. The sealing ring 3 is surrounded by a sleeve 5 which is guided on a cylindrical section 6 of the injection valve 1.

For retaining the injection valve 1 in a suction pipe 7, only schematically illustrated, the injection valve 1 is inserted with its mouthpiece 2 into a wall aperture 8 of the suction pipe 7 whereby the retention of the injection valve 1 is achieved essentially by the compressed sealing ring 3 between the wall aperture 8 and the mouthpiece 2. The wall aperture, respectively, mounting bore 8 includes a bevel or chamfer 9 on its insertion side.

The sleeve 5 which is provided according to the present invention has at its forward end a conically shaped outer contour 10 which passes over into a cylindrical section 11. The cone angle is thereby equal to twice the bevel angle so that the sleeve 5 can be utilized at the same time for centering purposes of the injection valve 1 during the insertion operation.

The inner contour of the sleeve 5 consists of three sections whereby two cylindrically shaped sections 12 and 13 and a conical section 14 are provided. The cylindrical inner section 12 which is of larger diameter, thereby corresponds in its diameter to the outer diameter of the cylindrical section 6 of the injection valve 1. As a result thereof, the sleeve 5 is guided during the axial displacement.

The second cylindrical section 13 is constructed smaller in diameter than the section 12. Its diameter corresponds approximately to the outer diameter of the sealing ring 3. However, it is slightly smaller so that the sleeve 5 is securely held by the sealing ring 3 in the non-installed condition and protects the same against damages and soiling. The transition between the two cylindrical sections 12 and 13 is preferably constructed part spherically. This facilitates the emplacement of the sleeve on the injection valve.

The third inner section 14 which adjoins the cylindrical section 13 of smaller diameter, is constructed conically. The smallest diameter of the cone is slightly smaller than the inner diameter of the wall aperture 8. As a result thereof, it is achieved that during the insertion of the injection valve 1, the sealing ring 3 will not come into contact with the inwardly disposed edge of the bevel 9 and is damaged thereby.

In FIG. 2, the injection valve 1 is illustrated in its installed position. In order to reach from the position in FIG. 1, the position in FIG. 2, the injection valve 1 is axially displaced under slight pressure. The sealing ring is thereby squeezed by the conical section 14 into the wall aperture 8 with simultaneous axial forward displacement by the shoulder 4. As a result thereof, the injection valve 1 is retained and simultaneously the wall aperture 8 is sealed off. A further sealing toward the outside, and more particularly against soiling is formed thereby by the sleeve 5 which, in the installed condition, continues to be supported with its conical section 10 at the bevel 9.

During the retraction of the injection valve 1, the sleeve 5 is pressed manually against the bevel 9. The sealing ring 3 is taken along by the shoulder 4.1 during the pulling out operation and now slides again over the conical inner section 14 into the sleeve. A damage by the edges of the mounting bore, respectively, of the bevel 9, is thus precluded.

The retention of the sleeve 5 during the pulling out of the injection valve 1 by hand can be avoided in that the sleeve 5 is spring-loaded and is pressed by the spring into the position illustrated in FIG. 1. A radially arranged pin on the cylindrical section 6 of the injection valve may be provided as end stop which guides the sleeve by way of an elongated aperture.

While I have shown and described only one embodiment in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

I claim:

1. An injection valve having a mouthpiece adjacent a discharge end of the valve for mixture-compressing internal combustion engines, comprising plug-in connection means including said mouthpiece and an interposed rubber-elastic sealing ring means for retaining the injection valve at its discharge end in a wall aperture of a suction pipe, and sleeve means axially displaceably arranged on the injection valve and at the discharge end area of the mouthpiece, said sleeve means in a first end position surrounding the sealing ring means to protect the sealing ring and in a second end position releasing the sealing ring means to permit the sealing ring to retain the plug in sealing contact with the apparatus.

2. An injection valve according to claim 1, wherein the sleeve means includes a first cylindrical inner section and a second conical section at a forward end of the sleeve, a smallest diameter of the conical section being smaller than an inner diameter of the wall aperture.

3. An injection valve according to claim 2, wherein the first cylindrical inner section has two different diameter portions, a first and larger diameter portion serving as guide surface on a valve body of the injection valve and the second smaller diameter portion essentially corresponding to an outer diameter of the sealing ring means.

4. An injection valve according to claim 3, wherein the outer contour of the sleeve means includes a conically shaped section at the forward end.

5. An injection valve according to claim 4, in which the wall aperture has a bevel having a conical angle, and wherein the conical section of the sleeve has a cone angle which is approximately twice the cone angle of the bevel.

6. An injection valve according to claim 1, wherein an outer contour of the sleeve means includes a conically shaped section at a forward end.

7. An injection valve according to claim 6, in which the wall aperture has a bevel having a conical angle, and wherein the conical section of the sleeve has a cone angle which is approximately twice the angle of the bevel.

* * * * *